US011242216B2

(12) United States Patent
McComas

(10) Patent No.: US 11,242,216 B2
(45) Date of Patent: Feb. 8, 2022

(54) YARN TENSION AND BREAKAGE SENSOR SYSTEM

(71) Applicant: Gary M McComas, Lewisburg, WV (US)

(72) Inventor: Gary M McComas, Lewisburg, WV (US)

( * ) Notice: Subject to any disclaimer, the term of this patent is extended or adjusted under 35 U.S.C. 154(b) by 211 days.

(21) Appl. No.: 16/553,664

(22) Filed: Aug. 28, 2019

(65) Prior Publication Data

US 2020/0087103 A1 Mar. 19, 2020

Related U.S. Application Data

(60) Provisional application No. 62/723,547, filed on Aug. 28, 2018.

(51) Int. Cl.
*B65H 63/036* (2006.01)

(52) U.S. Cl.
CPC ..... *B65H 63/036* (2013.01)

(58) Field of Classification Search
CPC ..... B65H 63/036; D05C 15/18; D05C 5/02; D05C 5/04; D05B 19/12; D05B 69/36
USPC ..... 700/143
See application file for complete search history.

(56) References Cited

U.S. PATENT DOCUMENTS 3,722,231 A 3/1973 Cooke
3,858,416 A 1/1975 White et al.
4,078,505 A * 3/1978 Fitton ..... D05C 15/18 112/273
4,522,139 A * 6/1985 Beverly ..... D05C 15/18 112/273
4,802,762 A 2/1989 Hill, Jr.
4,807,829 A * 2/1989 Zollinger ..... B65H 59/22 200/61.18
4,970,974 A * 11/1990 Price ..... D05C 15/18 112/273
5,588,383 A * 12/1996 Davis ..... B65H 49/16 112/80.16
5,662,054 A * 9/1997 Bardsley ..... D05C 15/18 112/278
5,778,724 A 7/1998 Clapp et al.
6,985,789 B2 1/2006 Carlson et al.
(Continued)

FOREIGN PATENT DOCUMENTS

EP 0950742 A3 12/2000

*Primary Examiner* — Nathan E Durham
(74) *Attorney, Agent, or Firm* — Kimberly O Snead

(57) ABSTRACT

A yarn monitoring system for textile machine uses sensors to indicate yarn over tensioning and breakage. The sensors are contained within, or adjacent to, eyelets and monitor, sending signals to the controller, the speed of the yarn. The eyelets, each with a sensor, are within a body that also contains a circuit board which is in constant communication with the eyelets and software contained within a controller. The controller, in turn, is in constant communication with the textile machine. The software is preprogrammed by a user with an acceptable signal range for passage of the yarn past the sensors and a predetermined time period for the signal to remain outside the acceptable signal range. To prevent unnecessary shut down of the textile machine, the software averages the signal and, when the averaged signal remains out of the acceptable signal range for the preprogrammed time initiates communication to the textile machine.

16 Claims, 20 Drawing Sheets

(56) References Cited

U.S. PATENT DOCUMENTS

| | | | | |
|---|---|---|---|---|
| 7,204,137 | B1 | 4/2007 | Skalchunes | |
| 8,127,699 | B2 | 3/2012 | Hicks et al. | |
| 8,225,727 | B2 | 7/2012 | Wilson et al. | |
| 9,067,755 | B2 | 6/2015 | Barea | |
| 2009/0260402 | A1* | 10/2009 | Hicks ..... | B65H 63/0324 66/163 |

* cited by examiner

110
Start Machine
120
Scan Each Sensor Unit
122
Is the Signal About Zero
124
Yes
No
Add Raw Signal to Signal Average Based on User Sensitivity Setting
125
Is Signal within Signal Preset Range
128
Yes
No
Is Signal Out of Range For Present Period of Time
130
Yes
Identify Sensor
136
Stop Machine
126
Machine Stopped Await for restart
134

YARN TENSION AND BREAKAGE SENSOR SYSTEM

FIELD OF THE INVENTION

The invention relates to a sensing system for monitoring the tension and breakage of yarn on a textile machine.

BACKGROUND OF INVENTION

A number of textile improvements have sought to monitor tension and breakage in textile machines, however for the most part these monitoring devices have been mechanical. There has been some use of optical sensors, frequently in combination with mechanical members, to indicate breakage. Tension, however, is more difficult to monitor optically and has been primarily indicated through mechanical members or a mechanical/sensor combination.

SUMMARY OF THE INVENTION

A yarn monitoring system for tension and breakage within a textile machine, such as a tufting machine, uses sensors to indicate yarn over tensioning and breakage. The sensors, preferably photoelectric, are contained within, or adjacent to, eyelets dimensioned to receive a strand of yard. The sensors preferably monitor, sending signals to the controller, the speed of the yarn passing through the eyelet and past the sensors. The eyelets, each with a sensor, are within a body that also contains a circuit board which is in constant communication with the eyelets and software contained within a controller. The controller, in turn, is in constant communication with the textile machine. The software is preprogrammed by a user with an acceptable signal range for passage of the yarn past the sensors and a predetermined time period for the signal to remain outside the acceptable signal range. To prevent unnecessary shut down of the textile machine, the software averages the signal and, when the averaged signal remains out of the acceptable signal range for the preprogrammed time initiates communication to the textile machine. As each of the sensors has an ID, the software knows the location of the sensor having issues and maintains the machine in shutdown until repaired.

The averaged signals are constantly monitored to ensure that they remain within the preset range. If a signal is below the present range it indicates that the yarn is under tension and is monitored for the preset period of time and, if the signal is not returned to acceptable range, a signal is sent to shut down the machine. In instances where there is a lack of signal, indicating a break in the yarn, the machine shuts down after a programmed period of time.

In addition to the microprocessor, the control can contain a display element that displays machine status. The display element can be in communication with a printer and one or more monitors.

In order to monitor the tension and breakage of yarn during operation of a textile machine, a sensor bar is added containing eyelets and a circuit board connected to a microprocessor. The software in the microprocessor is preprogrammed with an acceptable signal range and time the signals can be out of that range. Once programmed, yarn passes through each eyelet and is monitored as it passes a sensor with signals being sent by the circuit board to the software. The signal data received by the software is compared with the acceptable signal range and if below for a time period greater than that preprogrammed, the machine is shut down due to over tensioning. If there is a lack of signal, the machine is shut down due to breakage.

BRIEF DESCRIPTION OF THE DRAWINGS

These and other objects, features, advantages and aspects of the present invention can be better understood with reference to the following detailed description of the preferred embodiments when read in conjunction with the appended drawing figures.

DETAILED DESCRIPTION OF THE INVENTION

As used herein the term "sensing bar" shall refer to the elements of the sensor system placed on a receiving bar to receive multiple dual yarn strands.

As used herein the term "yarn" or "thread" shall refer to multiple strands of filament for use in textile machines.

As used herein the term "data point" and "data points" shall refer to a voltage reading somewhere between +Voltage (+V) and ground (GND). This point is determined by the condition (presence, tension or absence) of the yarn as read by the sensors.

As used herein the term "eyelet" shall refer to a receiving and guide aperture for yarn in accordance with the invention.

As used herein the term "sensor unit" shall refer to a yarn receiving eyelet incorporating a sensor, either within or adjacent to the exterior, having the ability to gather and transmit data as yarn passes through the eyelet.

The disclosed sensor system monitors the tension and breakage of the yarn during the operation of a textile machine through the use of one or more optical sensors such as photoelectric sensors, using infrared, visible or laser, located in or adjacent to yarn eyelets. Tension that is too great will cause uneven yarns and is generally a precursor to yarn breakage. It is beneficial to operation to catch the over tensioning of a yarn prior to either breakage or causing a flaw in the finished product. Conversely, under tensioning can result in loose threads and thread loops. Although photoelectric infrared sensors are used herein, any sensor that can provide the required data can be used. The disclosed sensor system can be retrofitted to current machines or incorporated into machines by the manufacturer.

Figure 1:
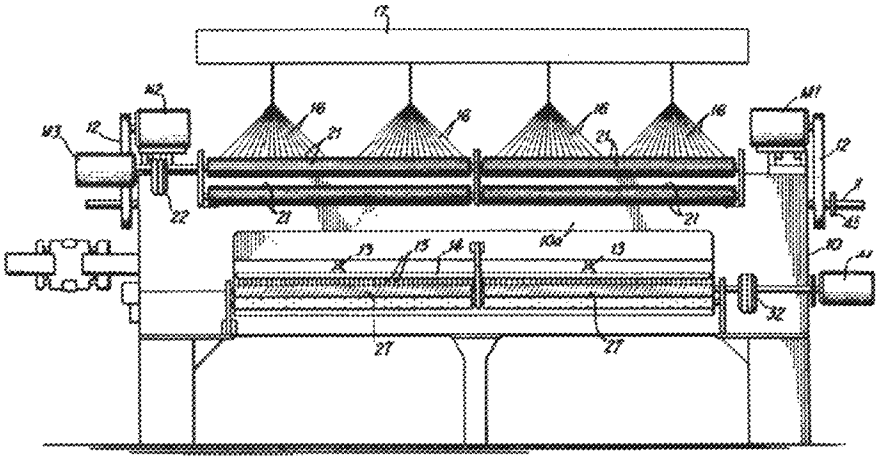
Figure 1 Prior Art
FIG. 1 is a front view of a prior art tufting machine.

A typical prior art tufting machine is illustrated in FIG. 1 as a reference to the general state of the art of one of the machines to which the disclosed sensor system is applicable. Other machines, such as knitting, weaving, non-woven, etc., can readily use the disclosed sensor system with minor re-dimensioning of the sensor bar. For ease of description herein, the sensor system is being described in conjunction with a tufting machines, however other applications will be evident to those skilled in the art.

Figure 2:
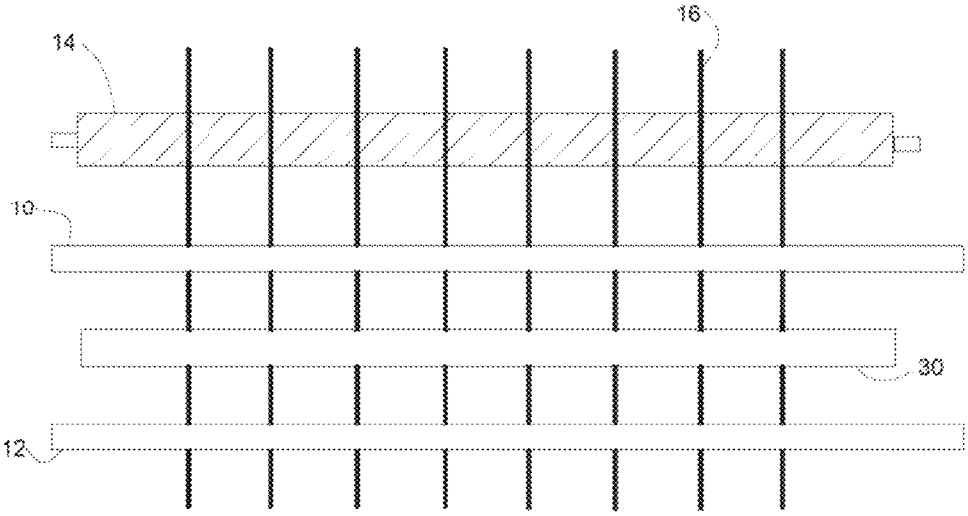
FIG. 2 is a side view of a portion of a machine illustrating the placement, with respect to the prior yard guides, of the sensor bar in accordance with the disclosed invention.
Figure 3:
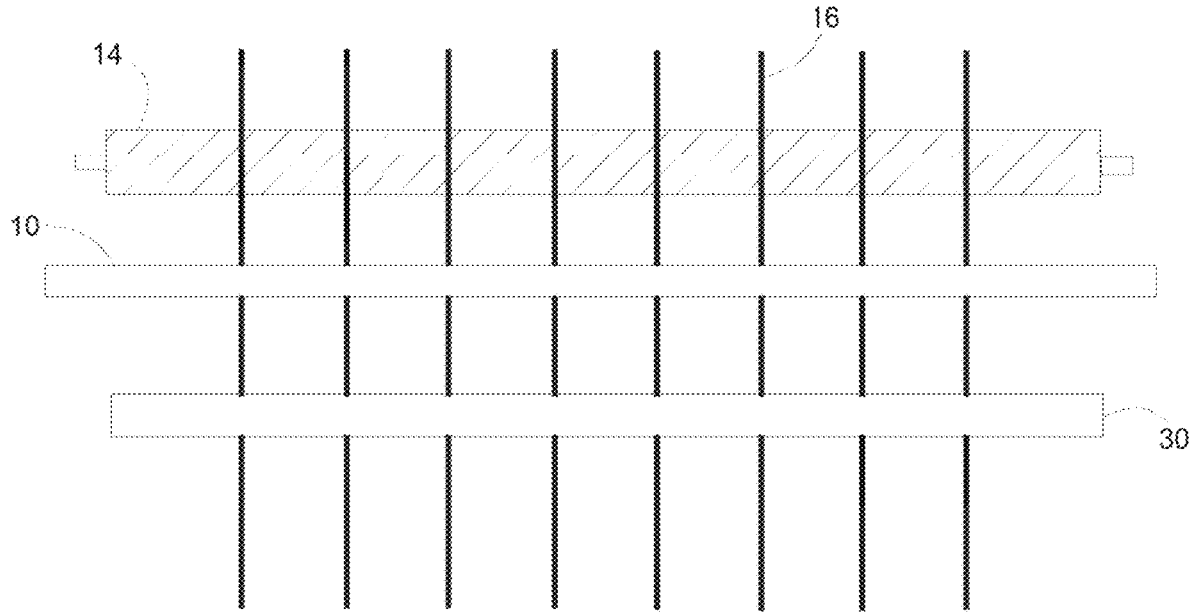
FIG. 3 is a side view of a portion of a machine containing the sensor bar in accordance with the disclosed invention.

FIG. 2 illustrates the sensor bar 30 with respect to the placement within a tufting machine without removal of the prior art yarn guide 12. The strands of yarn 16 come from the creel (not shown) past the drive roller 14, through yard guide 10 and would, in prior art machines, pass though the lower yarn guide 12. From the yarn guide 12, the yarn moves to the tufting machine needles (not shown). In FIG. 3 the lower yarn guide 12 has been removed and replaced with the sensor bar 30, easily retrofitting the existing machine with the disclosed technology. As with the prior operation, the strands of yarn 16 extend from the creel (not shown), through the yarn guide 10 to the sensor bar 30 and on to the tufting machine needles (not shown). Although the lower yarn guide 12 is illustrated herein as being replaced by the sensor bar 30, it should be noted that the sensor bar 30 can replace any of the yarn guides on applicable machines.

Figure 4:
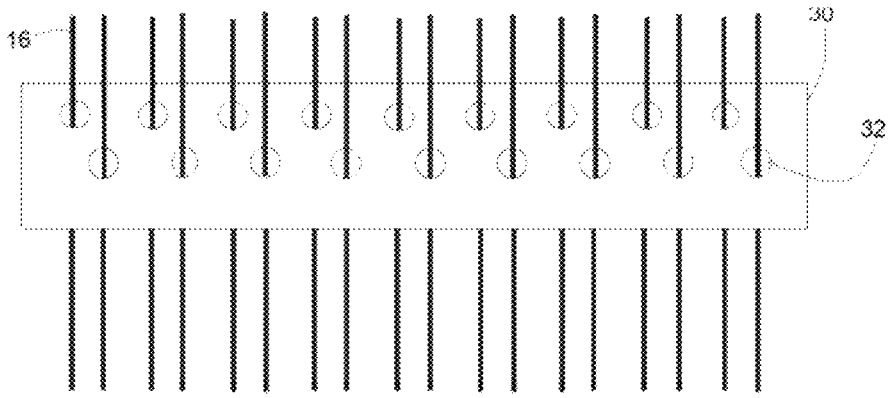
FIG. 4 is a perspective view of the sensor bar in accordance with the disclosed invention.

A top view of the sensor bar 30 is illustrated in FIG. 4 showing the multiple receiving eyelets 32, one for each strand of yarn 16. The receiving eyelets 32, each having an inlet and outlet, are positioned within the sensor bar 30 to smoothly, and directly, receive the yarn 16. Although there is some flexibility as to the angling of the yarn entry into the receiving eyelets 32, the greater the angle, the greater the reduction of tension sensitivity. Optimally, the receiving eyelets 32 will be directly aligned with the yarn guide. The number of receiving eyelets 32 will vary depending on the machine capabilities.

Figure 5:
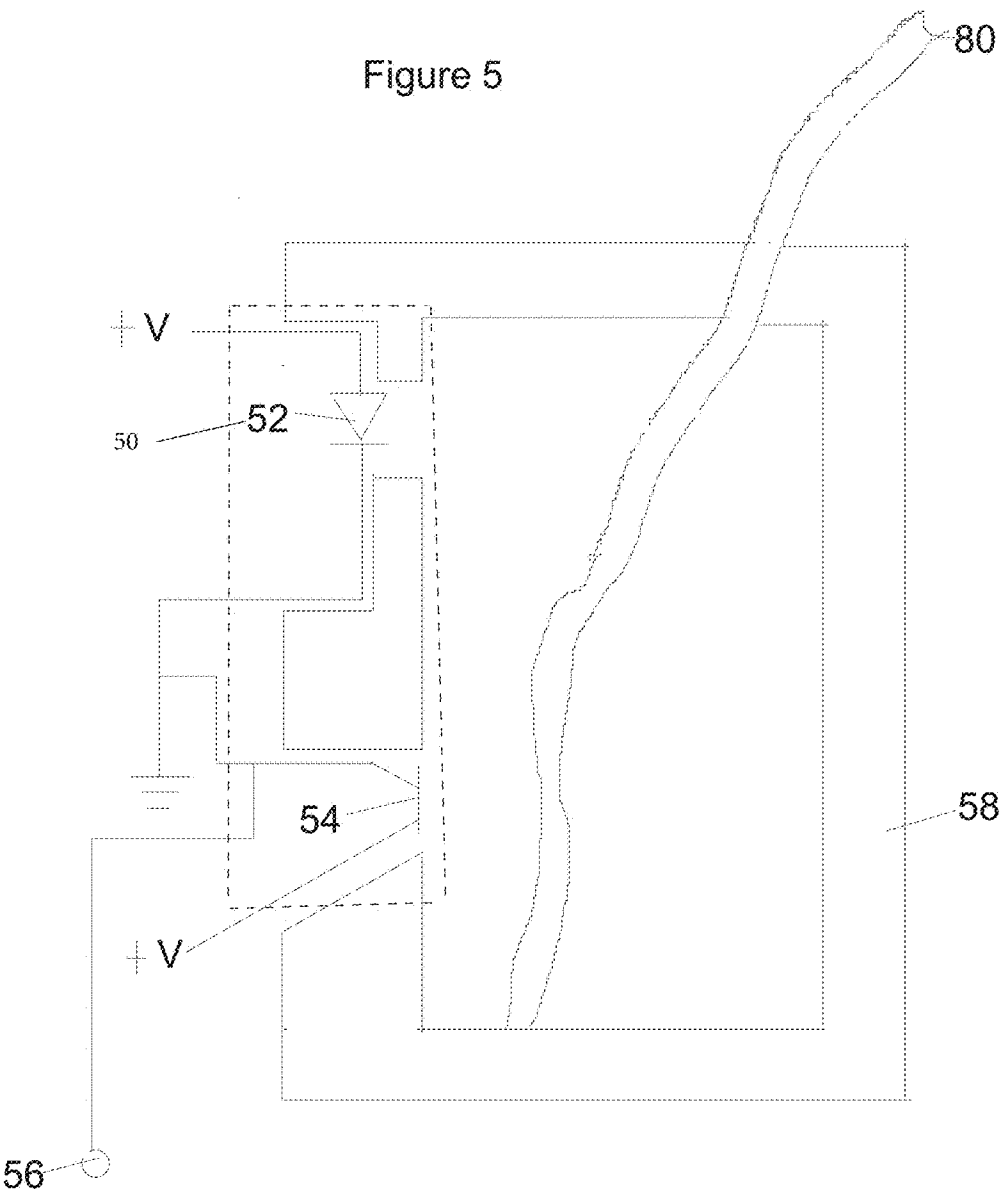
FIG. 5 is a schematic view of an example sensor configuration in accordance with the disclosed invention.
Figure 7:
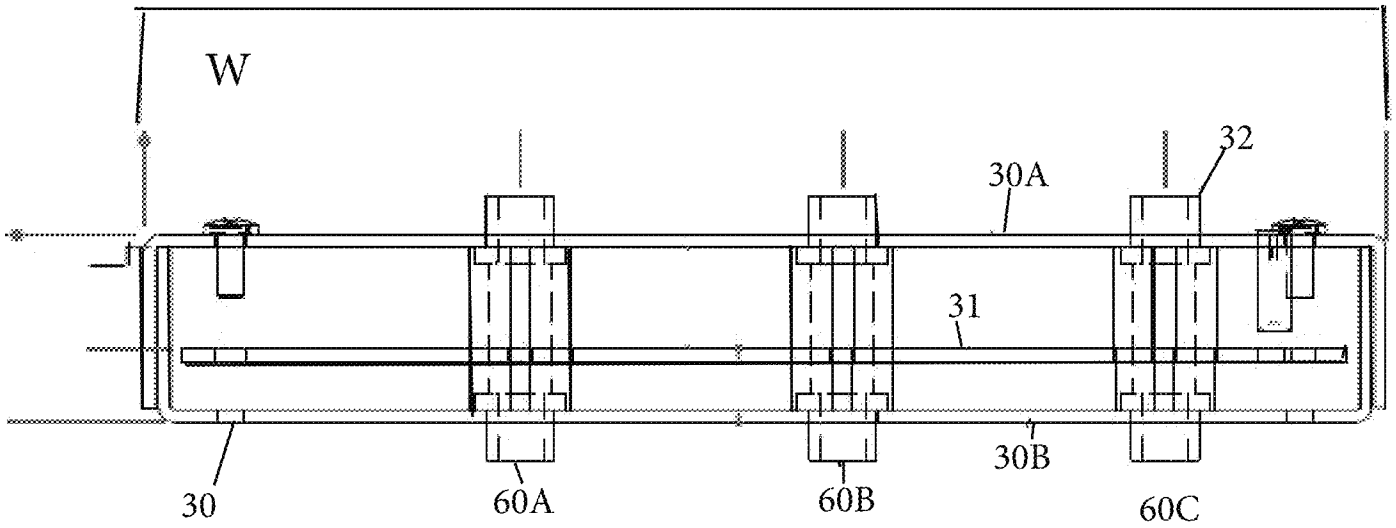
FIG. 7 is a perspective view of the sensor bar illustrating an example eyelet arrangement in accordance with the disclosed invention.

The ability to accurately monitor yarn tension, breakage, and movement is achieved through the use of sensors and preferably a photoelectric sensor 50, an enlarged example of which is illustrated in FIG. 5. The infrared transmitter 52 and photo transistor 54, forming the sensor 50, are positioned to read the speed of passage of the yarn 80. The sensor 50 can be contained within the thread eyelet 58, as illustrated in FIG. 5, or adjacent to the eyelet 60 as illustrated in FIG. 7 The transmitter 52 sends light signals which are then received by the photo transistor 54 after striking the yarn 80 thereby reading the speed of the yarn 80. The continuous speed readings are communicated to a circuit board within the sensor bar 30 and then to a microprocessor as described hereinafter in conjunction with FIG. 8.

Figure 6:
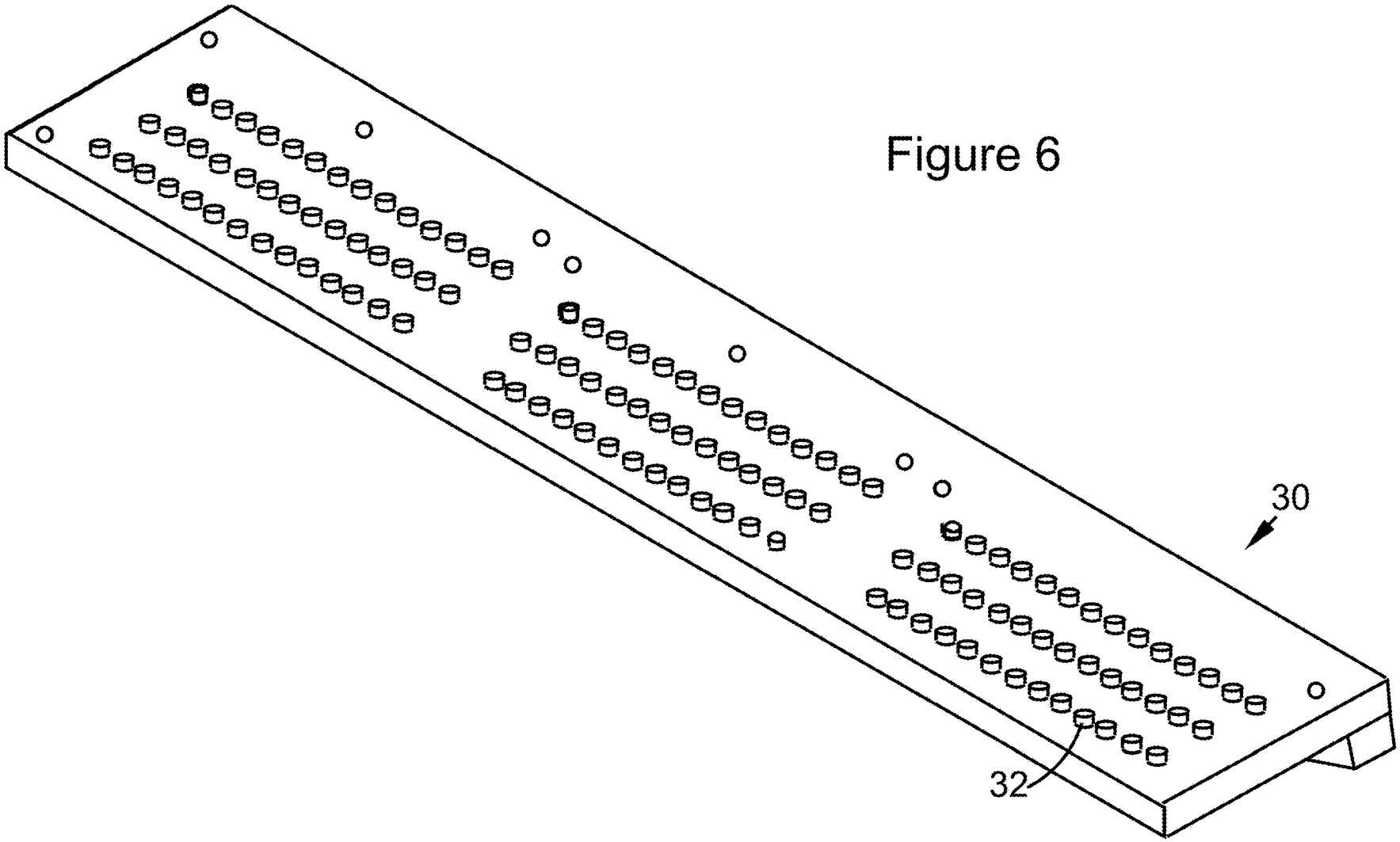
FIG. 6 is a cutaway end view of the sensor bar illustrating a portion of a row of sensors units in accordance with the disclosed invention.

The example arrangement described herein for illustration purposes is a sensor bar 30 having three eyelet 32 rows deep as illustrated in FIG. 6. In FIG. 7, the side view of the three-sensor unit 60 row is illustrated as it would be positioned in the sensor bar 30 when viewed from the end of the bar 30. The bar 30 in this example has a width W of 6.396 inches with sensor unit 60A placed at 5.258 inches; sensor unit 60B at 3.598 inches; and sensor unit 60C at 1.938 inches. The distance between the top surface 30A and the bottom surface 30B is 0.961 inch. The foregoing dimensions are provided as examples and can vary depending on the machine and its end purpose. Changes to the above dimensions will be evident to those skilled in the art.

The circuit board 31 within the sensor bar 30 carries the sensor electronics and is secured to the sensor bar 30 in any manner known in the art that will not obstruct the path of the yarn. The circuit board 31 is responsible for sending the signals received from the sensor units 60 to a microprocessor.

Figure 8:
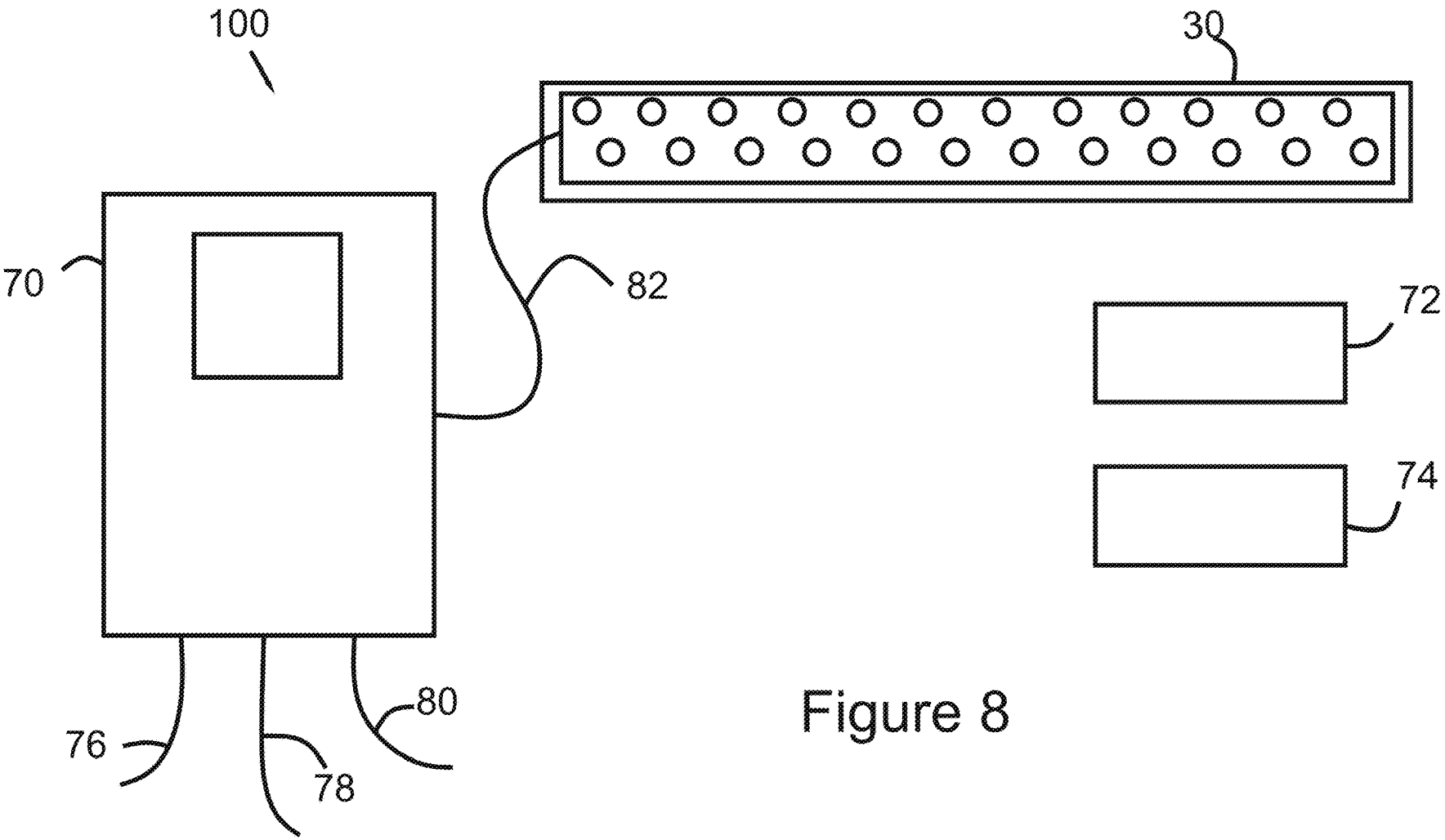
FIG. 8 is a block diagram of an example equipment configuration in accordance with the disclosed invention.

A block diagram of the sensor system 90 is illustrated in FIG. 8 showing the sensor bar 30 connected, through the circuit board 31, to the controller 70. The connection between the circuit board 31 and the controller 70 can be wired, such as an RS485 com link 82, or wireless. The controller 70 is a microprocessor, connected to a power source through cable 76, having sufficient computing to run standard averaging software, display graphics, maintain databases, etc. The controller 70 is connected to an on/off or override switch on the textile machine through connection 78 to enable the controller 70 to shut down the textile machine upon the identification of predetermined criteria as noted hereinafter. Control line 80 connects the controller 70 directly to the machine (not shown) to enable the controller 70 to know when the machine is running and when it is stopped through the presence or absence of voltage. The controller 70 preferably has the ability to send output to a remote display 72 and printer 74 for standard reporting of machine status and can also contain a display 82 directly on the controller 70 to provide any visual readings necessary in addition to, or instead of, the display 72. The interaction between a controller 70 and the auxiliary input and output devices, including alarms, is known and the appropriate set up will be evident to those skilled in the art. Although communication can be wireless, hardwired communication is preferable in order to avoid the loss of communication that can occur with wireless. Additional elements, alarms, lights, etc., to indicate that the machine has been stopped can also be incorporated and the addition of such will be known to those skilled in the art.

The photoelectric sensor signal is gathered by the circuit board 31, sent to the microprocessor, and converted from analog to digital. The microprocessor reads the signal voltage and compares the voltage received from all sensors to the preprogrammed voltage range.

As noted heretofore, optimum results in monitoring tension are achieved when the receiving eyelets 32 are in direct alignment with the eyelets of the yarn guide 12, making the placement of the sensor pairs 60 critical.

The controller 70 is programmed with the identification and location of each sensor unit 60, permitting the algorithm to differentiate yard anomalies and the location. The controller 70 is in constant communication with the circuit board 31 within the sensor bar 30, monitoring the speed of the yarn while the algorithm continuously analyzes the data received. When the readings indicate a yarn is either under unacceptable tension, or there is a lack of yarn, a signal is sent to stop the machine.

Figure 9:
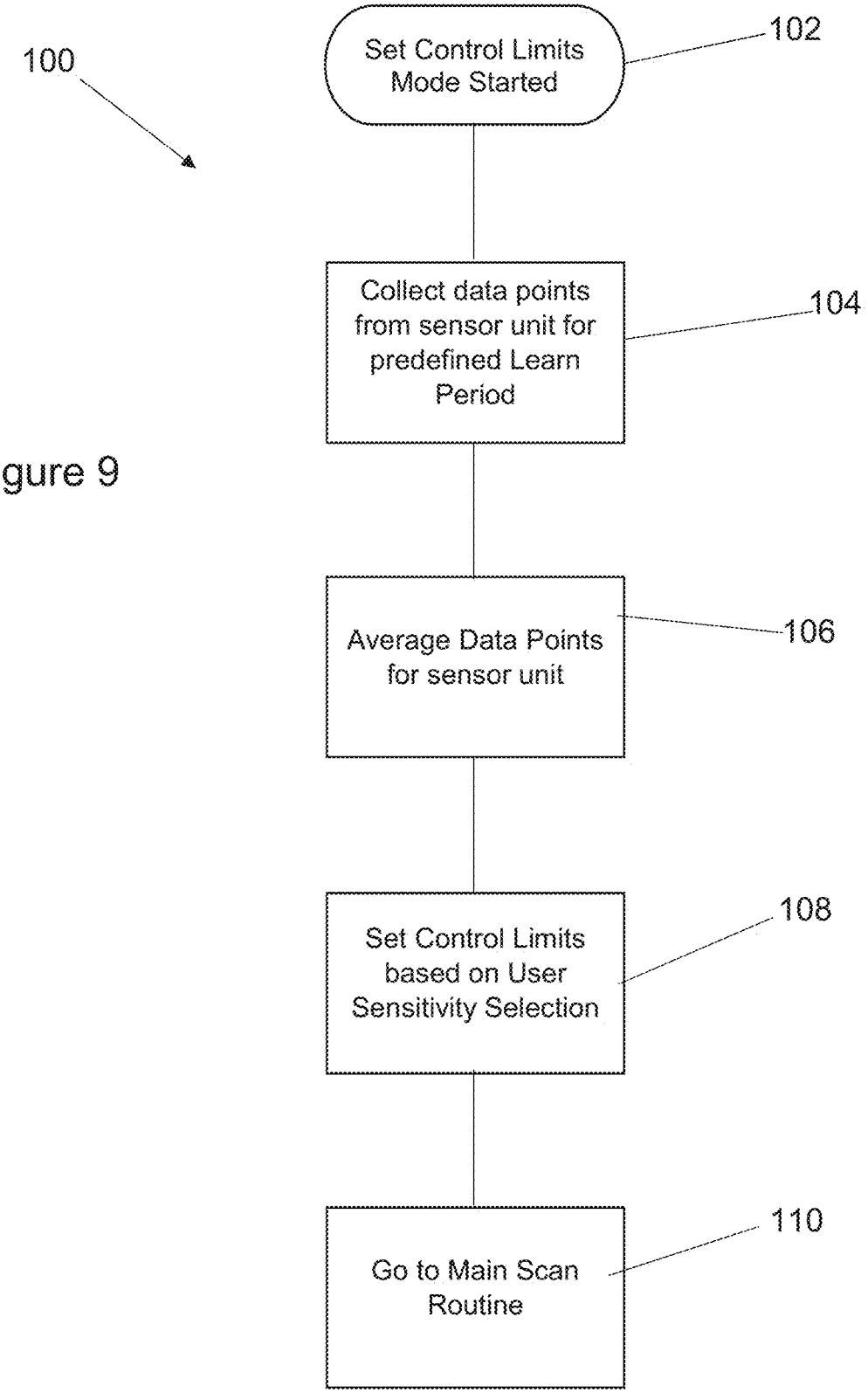
FIG. 9 is a flow chart illustrating the initial set up of the upper and lower reading limits in accordance with the disclosed invention.
Figure 11:
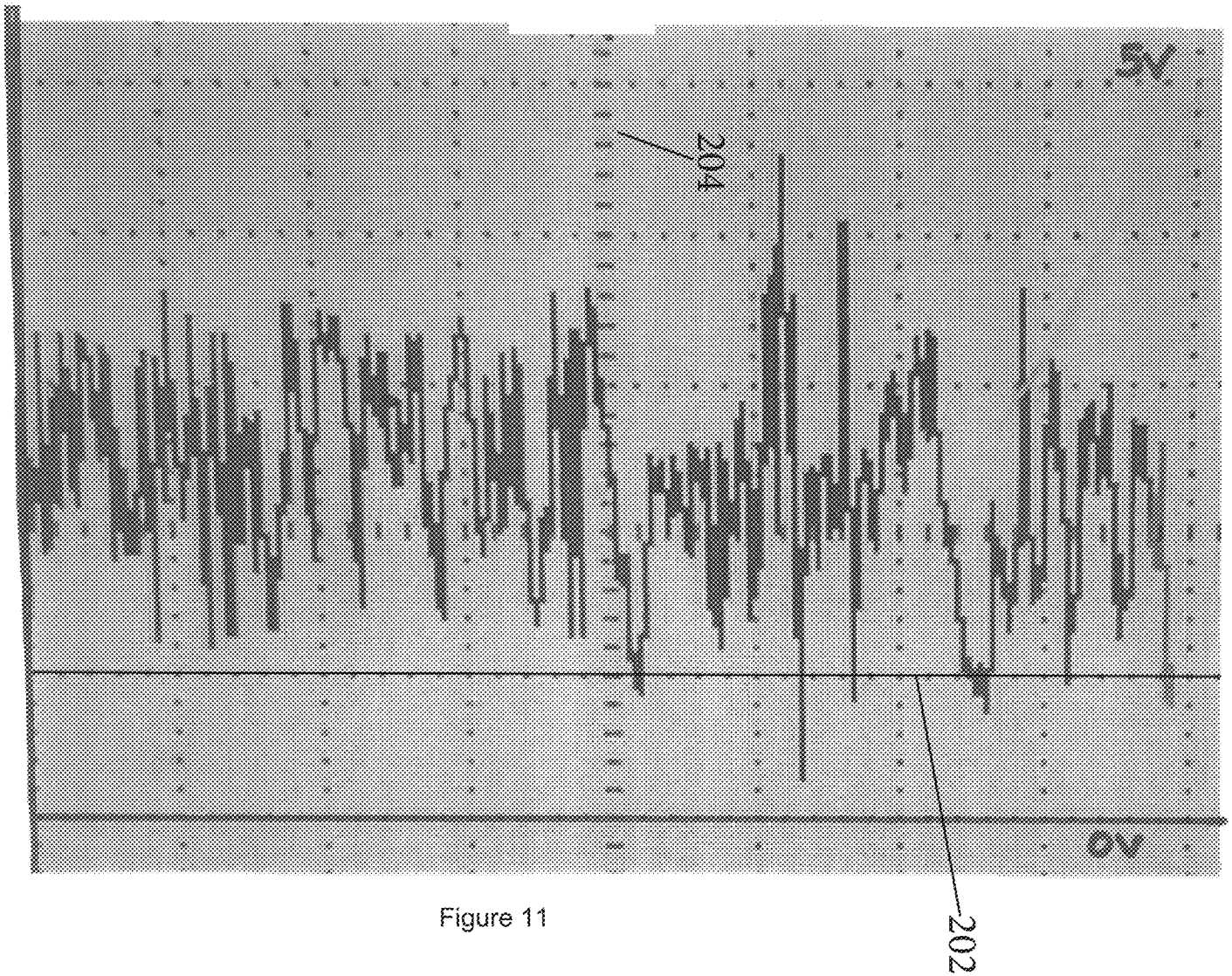
FIG. 11 is a graph illustrating readings from threads within present limits, in accordance with the invention.

The flow chart of illustrating the initial set up program 100 of the acceptable upper and lower reading limits is illustrated in FIG. 9. The control mode is manually started 102 and the data points (+V and GND) collected from each sensor unit 60 to determine their current settings. Each eyelet 32 receiving a thread has its own sensor with its ID and location known by the algorithm within the controller 70. When the signals indicate that the tension is within the predetermined range, the signals will be approximately mid-scale on the graph (FIG. 11). From this average an algorithm will determine an acceptable signal range for the specific yarn and application. If a defect occurs during the running of the machine (tension too high or broken yarn) the readings will change to outside the control limits as disclosed in more detail hereinafter. Once the data points are averaged 106, the upper and lower limits are set 108 by identifying minimum and maximum readings of each sensor unit 60. The control limits, minimum and maximum readings, as well as any time settings, are based on user selected sensitivity. Once the signal range is set, the controller 70 initiates the main scan program 110. Since the yarn when running at its proper tension is almost identical in its presentation, the signal, or range of high and low data points, will be somewhere around the mid-scale point. Mid-scale is not uniform throughout all of the sensor units 60 and will vary from unit to unit. The difference, however, is small and as long as the mid-point between the upper and lower limits, as set in 108, is within the present limits, the difference does not affect operation. As with all settings, the sensitivity can vary with the type of carpet being tufted, or product being produced by the textile machine, and the adjustment of the applicable signal range will be known to those skilled in the art. In some embodiments, dependent on the machine, the acceptable signal range can be set by initial programming based upon the end product.

In addition to the monitoring of the sensor units 60, the controller 70 also performs overall "health checks" on the machine without interference with the sensor units 60 readings.

Although the examples disclosed herein have been directed to indicating yarn tension above the preset range and breakage, the controller 70 can also be programmed to control the speed of the yarn. By increasing and/or decreasing the speed to the yarn within the preset range, the controller 70 can vary the resulting product of the textile machine.

Figure 10:
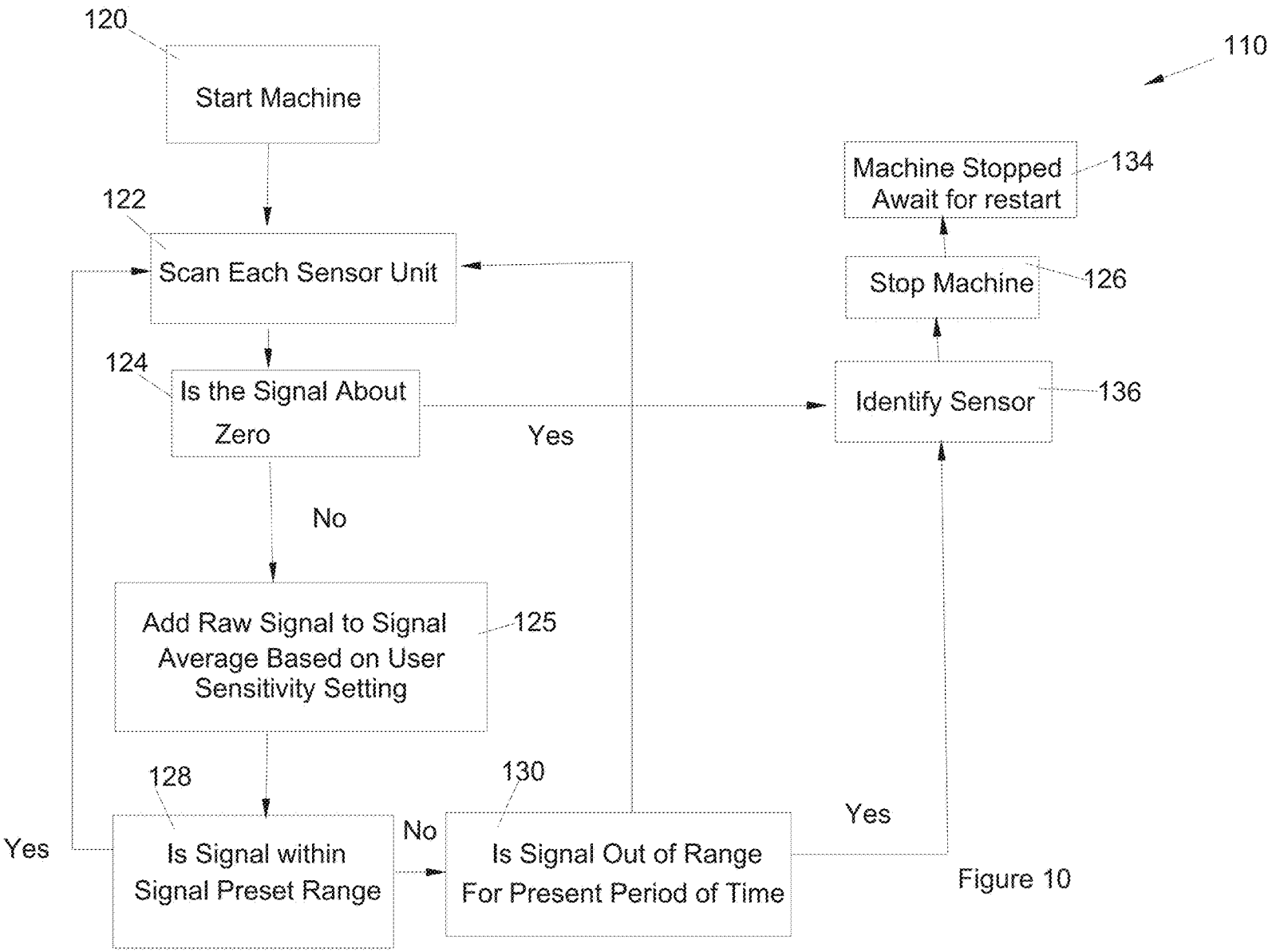
FIG. 10 is a flow chart illustrating the thread scanning steps in accordance with the disclosed invention.

The sequence of the main scan program 110 is shown in FIG. 10 wherein once the machine is started 120, voltage from each sensor unit 60 is continuously scanned 122 by the microprocessor to determine if the signal is within the present acceptable signal range, or control limit, 124. If the signal is about zero 124, the sensor unit 60 is identified 136, the stop machine signal 126 is sent, and once the faulty sensor is indicated the system waits for restart 134. If the signal is not below the control limit 124, the raw signal is average based on user settings 125 and the signal is checked to see whether the signal is within the present control limit 128. If the signal is within the present range, the program returns to the scan mode 122. If the signal is out of the preset range, the preset time period is checked 130. If the time period is not met, the system returns to scan mode 122. If the preset time period 130 for being out of range is met, the sensor is identified 136, the stop signal 126 is sent, and the machine stopped to await restart 134.

In summary, when signals are about zero it serves as an indication that the thread is broken. When the signals received from the sensors fall below the control limit 130, the yarn is under greater tension than the present range. If that tension continues, the machine is stopped.

FIG. 11 is a graph 200 illustrating the readings as received from a sensor unit 60 where the thread is moving through the eyelet 30 and past the sensor unit 60. The readings that fall within the preset range control limit are roughly uniform with the threads varying to some degree while predominately remaining in the preset control limit range as indicated on the graph as Y 202 and X 204. As can be seen some of the readings fall outside of the graph range X 204 and Y 202 however most stay within the indicated range.

As the thread is moving rapidly within the sensor units 60, the software uses averaging over a period of time as preset by the user and is based on the machine and yard type. The averaging of the voltage readings over a period of time compensates for the speed of the yarn as it passes through the sensor units 60.

Figure 12:
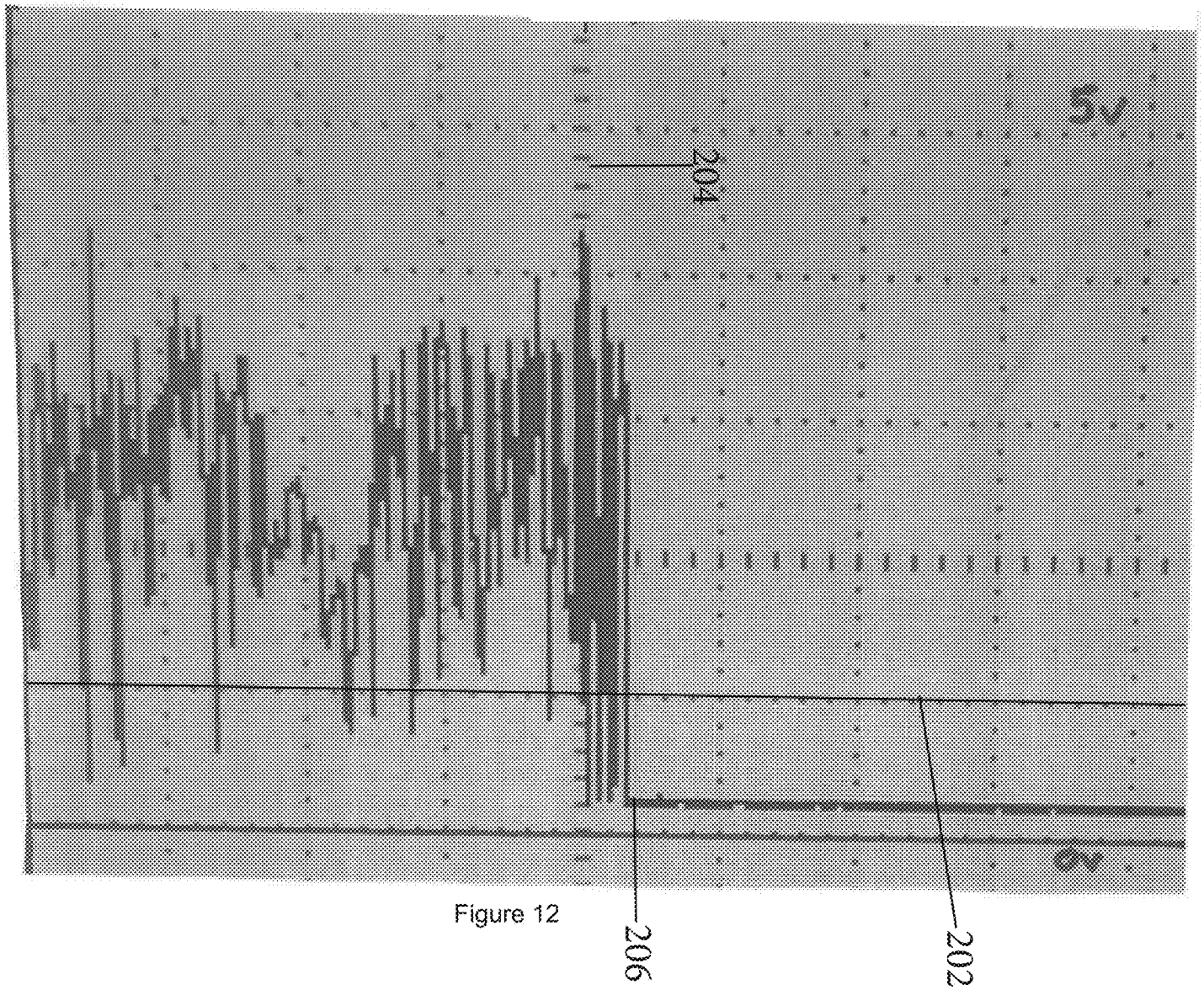
FIG. 12 is a graph illustrating readings from a broken thread outside present limits, in accordance with the invention.
Figure 13:
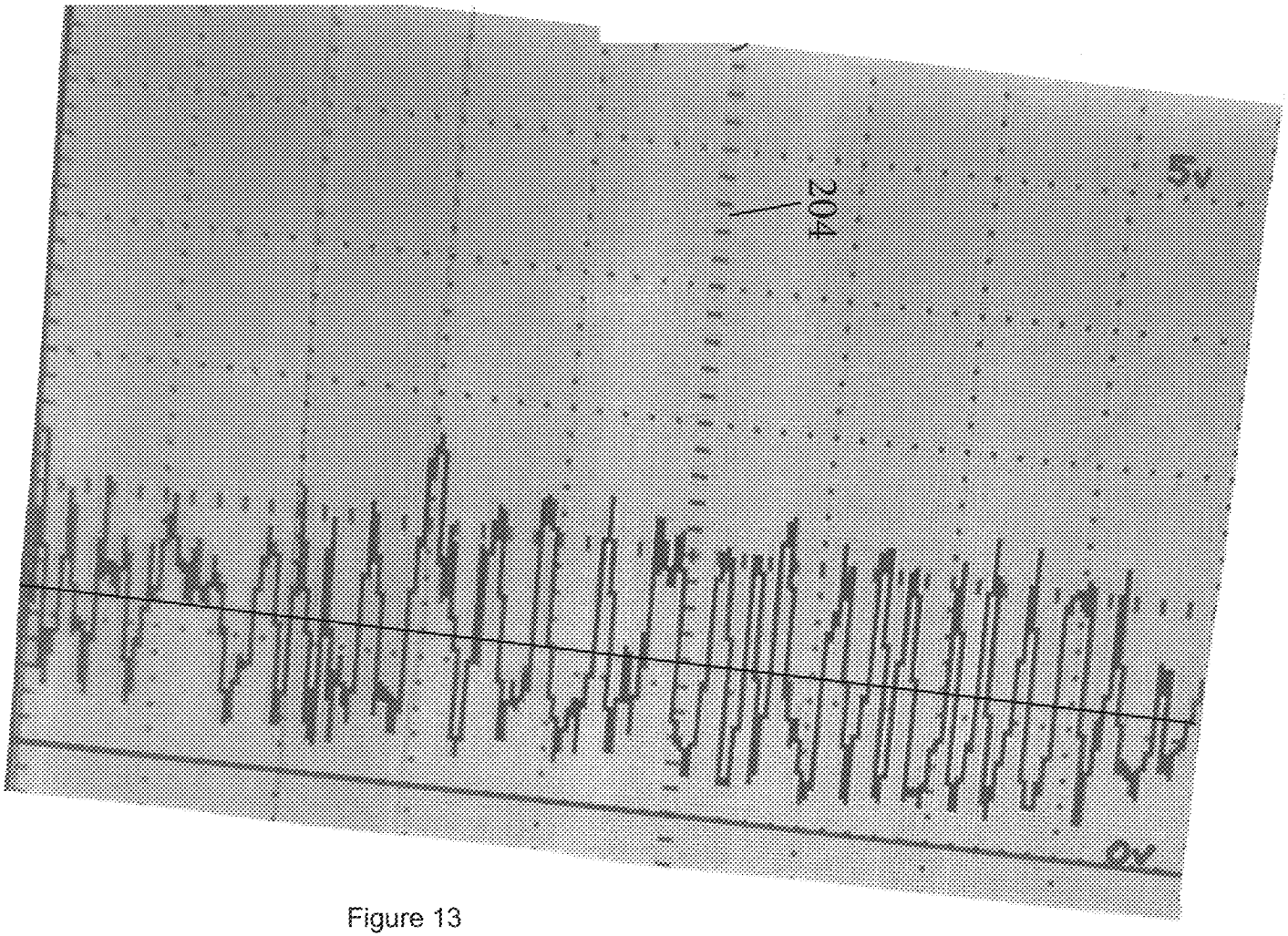
FIG. 13 is a graph illustrating readings from an over tensioned thread, in accordance with the invention.

In FIG. 12 the readings illustrate an increase to threads below the Y 202 until, as indicated at breakage point 206, the yarn breaks and the signal drops to zero volts. Once the software within the controller 70 reads the lack of activity for a preset period of time, generally 0.25 seconds, the machine is shutdown. FIG. 13 illustrates readings indicating over tensioning, or tight end. The programming for over tensioning is preset by the user and is based upon the number of consecutive averages that fall below the preset range within a predetermined time period. Once the present number of averaged raw signals fall below the set range within the predetermined time period the software determines there is over tensioning. By making the determination for shut down of the machine based on a number of consecutive readings over a time basis number of signals below the average, shutdowns based on one or two readings are prevented.

Figure 14:
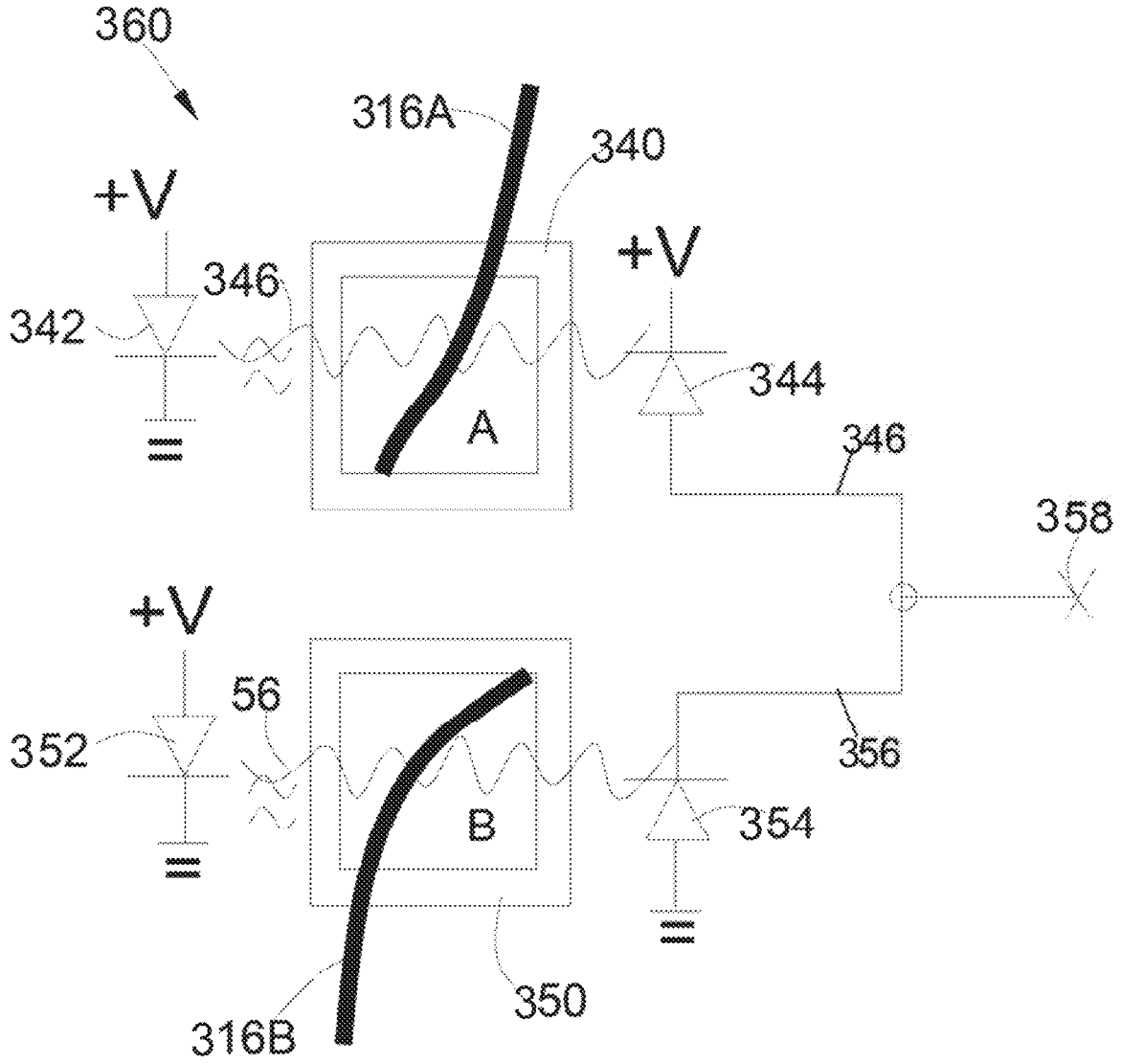
FIG. 14 is a schematic view of the dual sensors of the sensor system in accordance with the disclosed invention.

The example arrangement described hereto for illustration purposes illustrated in FIG. 7 is also applicable in an alternate embodiment using dual sensors. Rather than the single sensor 50 as illustrated in FIG. 6, dual sensors are incorporated into the eyelets. FIG. 14 illustrates a top view of the sensor row of FIG. 12 showing the pair of sensors 340 and 350. As seen in this figure, threads 316A and 316B pass through the receiving eyelets 332 and between the transmitting diode 342 and receiving diode 344 (sensor 40) and transmitting diode 352 and receiving diode 354 (sensor 50), which together form sensor pair 360.

The initial set up process of the acceptable upper and lower reading limits, as well as the sequence of the main scan program described hereto for in conjunction with the single sensor 50 is also applicable for the dual sensors with the exception that an upper limit, in addition to the lower limit is also set.

Figure 15:
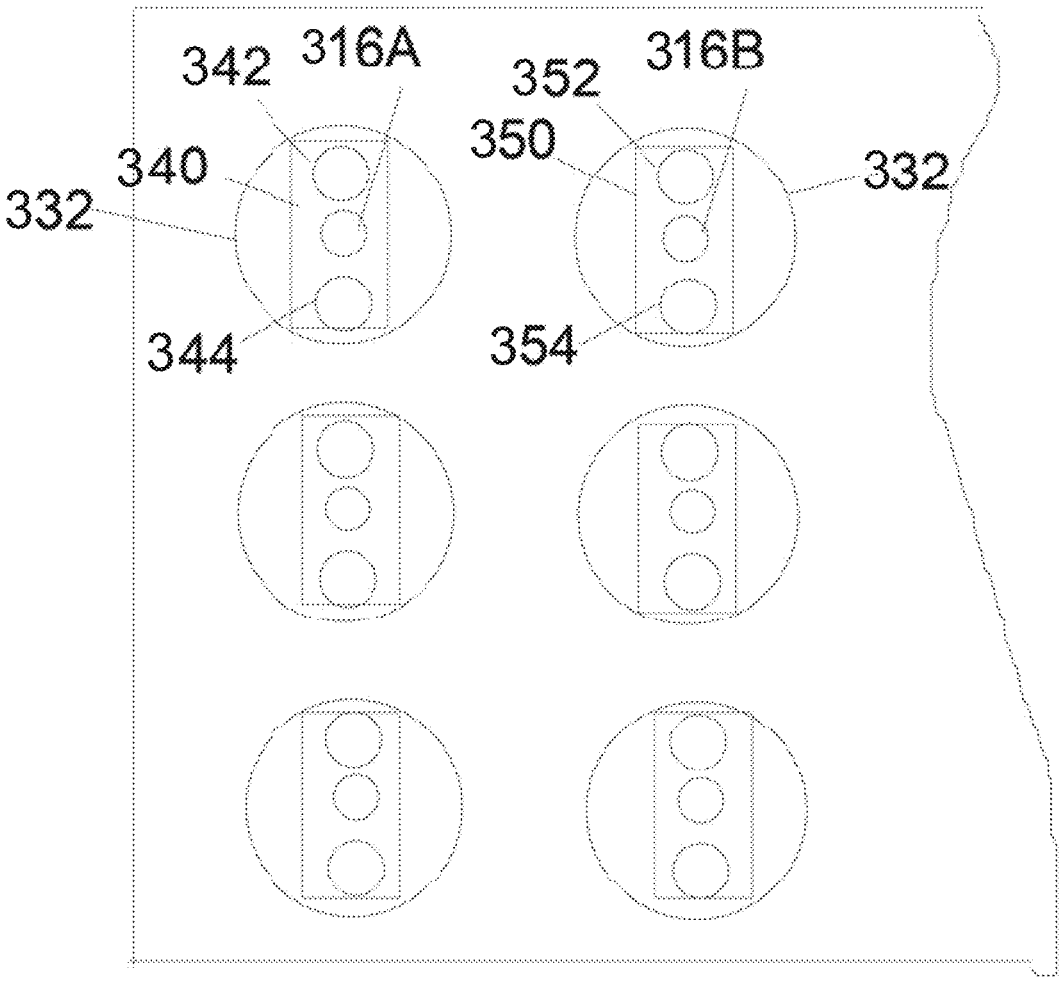
FIG. 15 is a top view of the sensor row in accordance with the disclosed invention.
Figure 16:
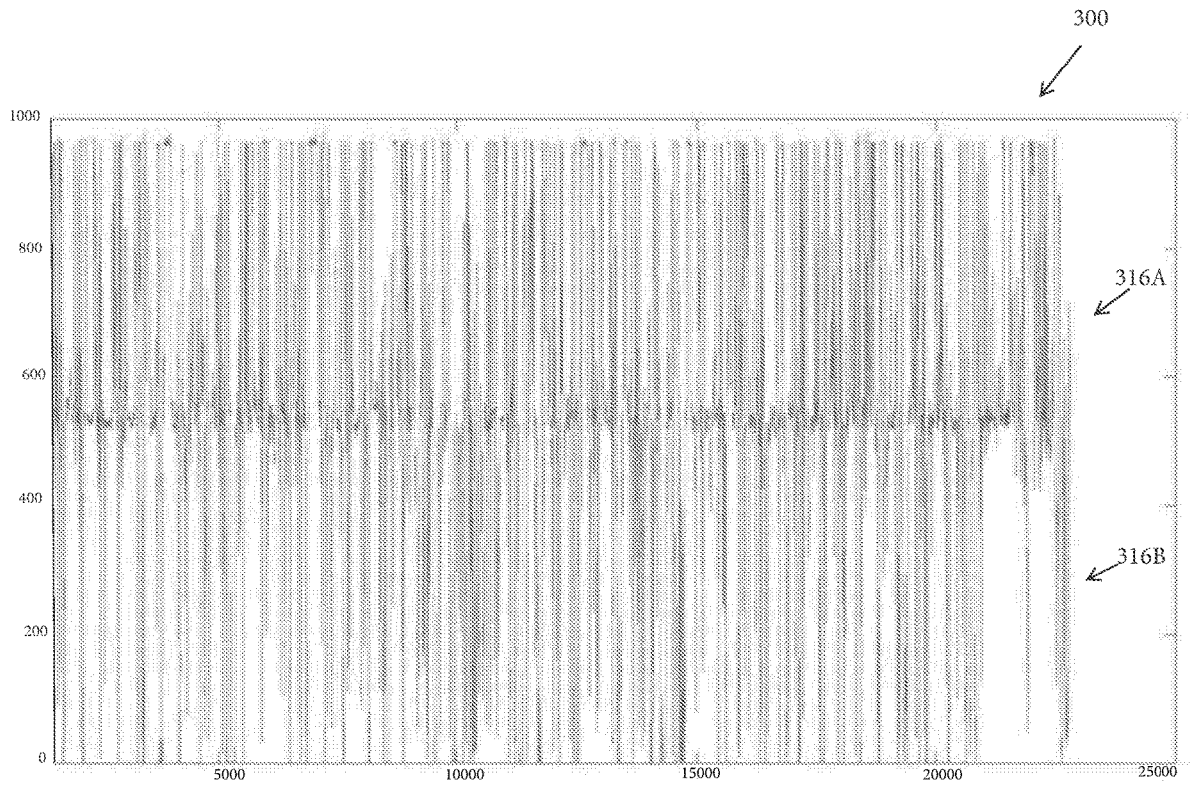
FIG. 16 is a graph of the readings received from a sensor pair when thread tension is within programmed settings in accordance with the disclosed invention.
Figure 17:
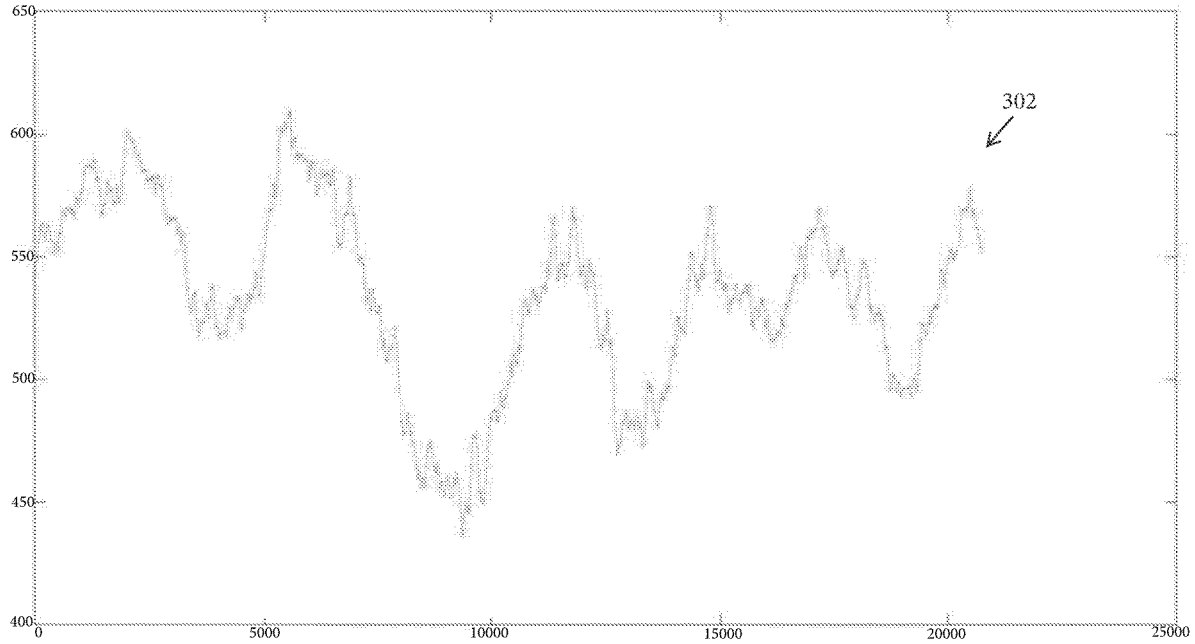
FIG. 17 is a graph of the average from FIG. 16 in accordance with the disclosed invention.
Figure 18:
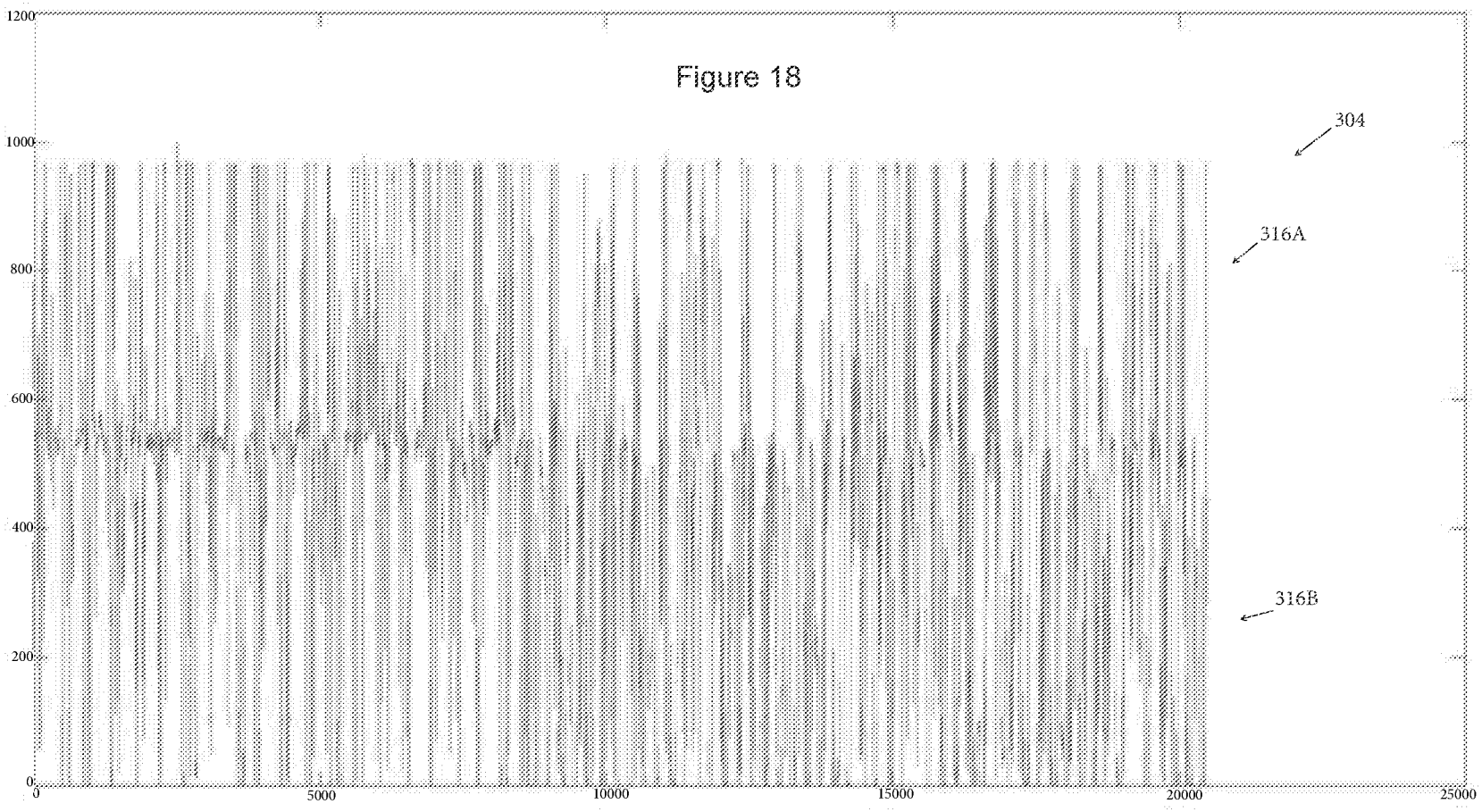
FIG. 18 is a graph of the readings received from a sensor pair when one in the pair indicates that the thread tension is not within programmed settings in accordance with the disclosed invention.
Figure 19:
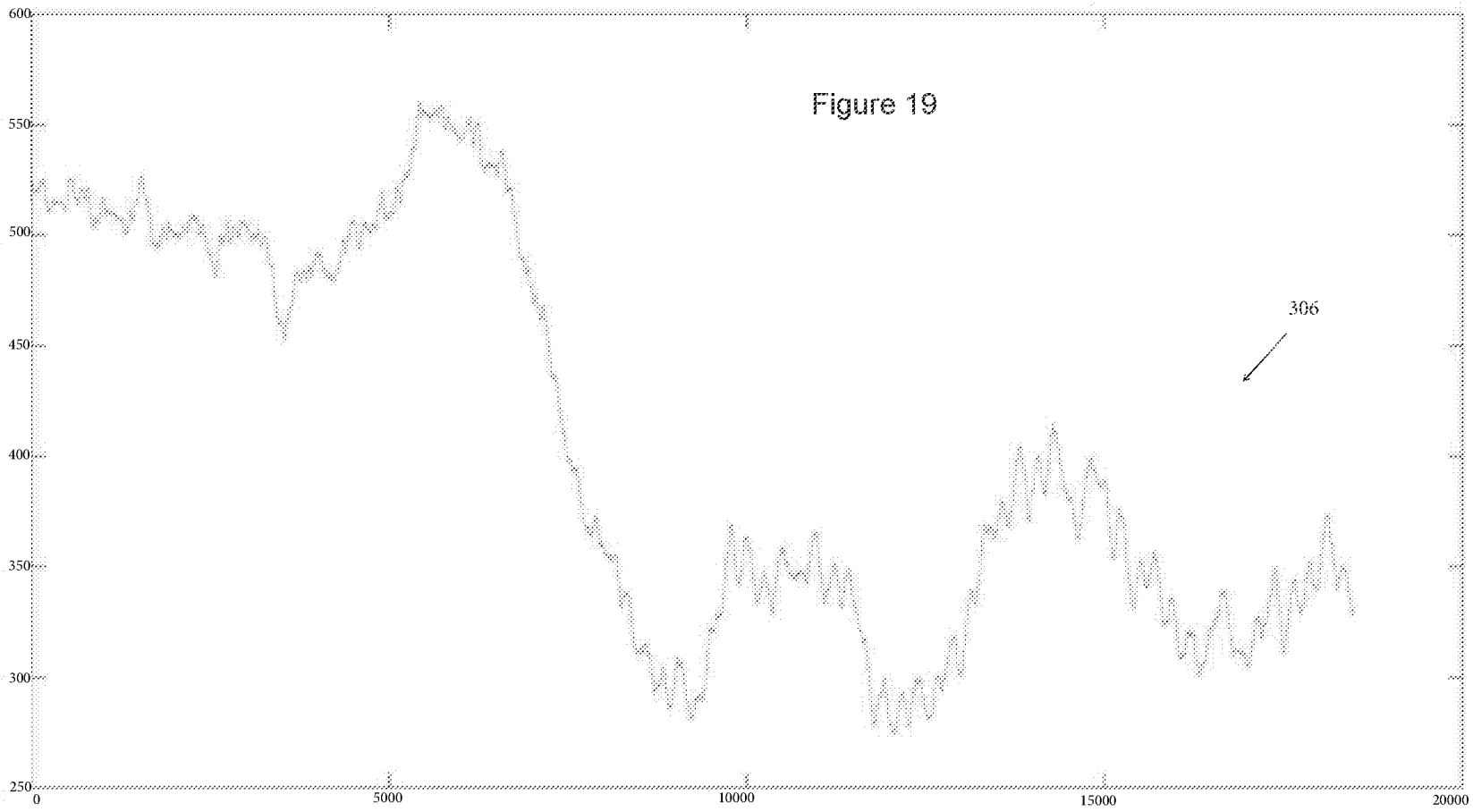
FIG. 19 is a graph of the average from FIG. 18 in accordance with the disclosed invention.
Figure 20:
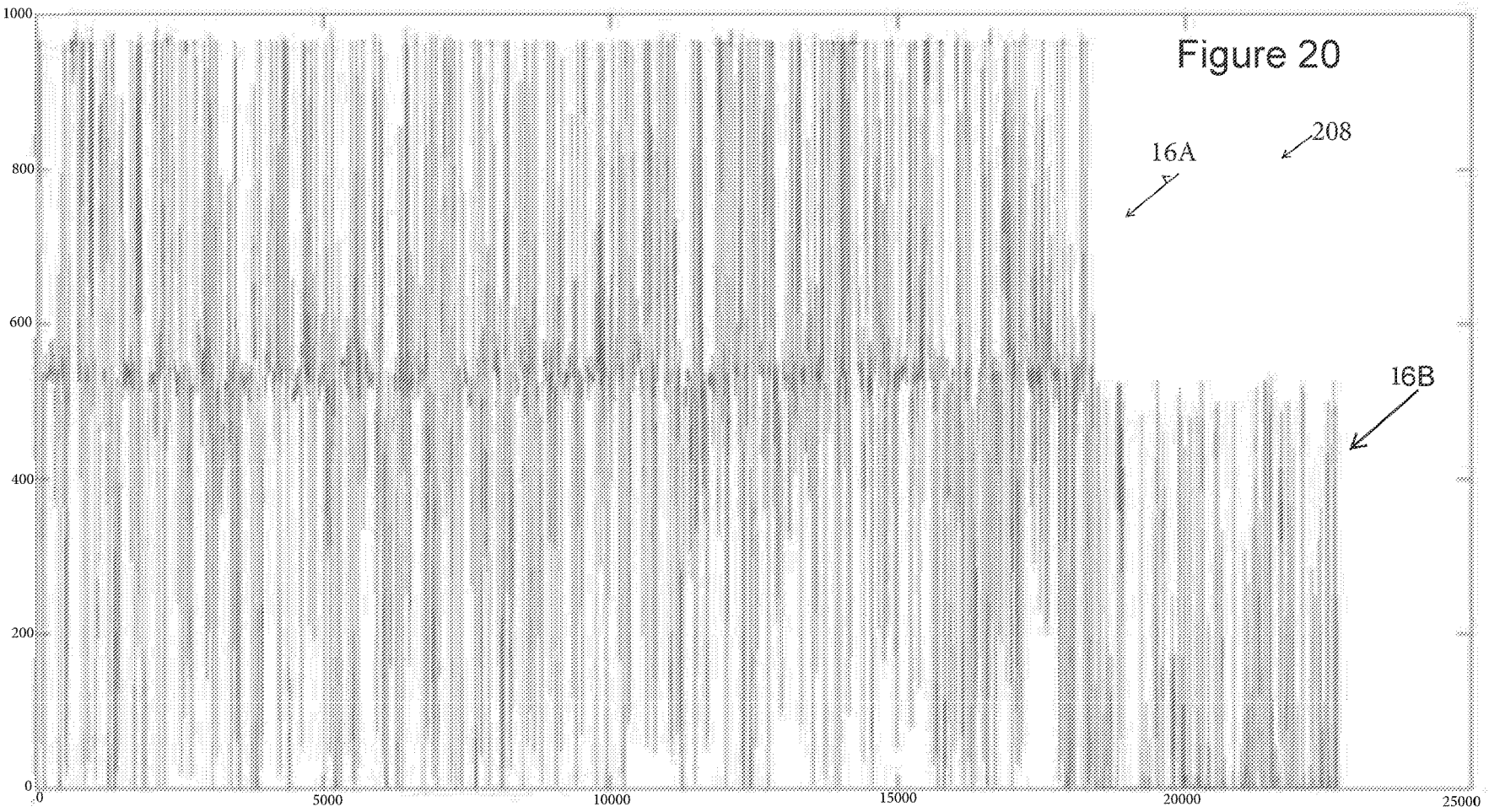
FIG. 20 is a graph of the readings received from a sensor pair when one in the pair indicates a broken thread in accordance with the disclosed invention.
Figure 21:
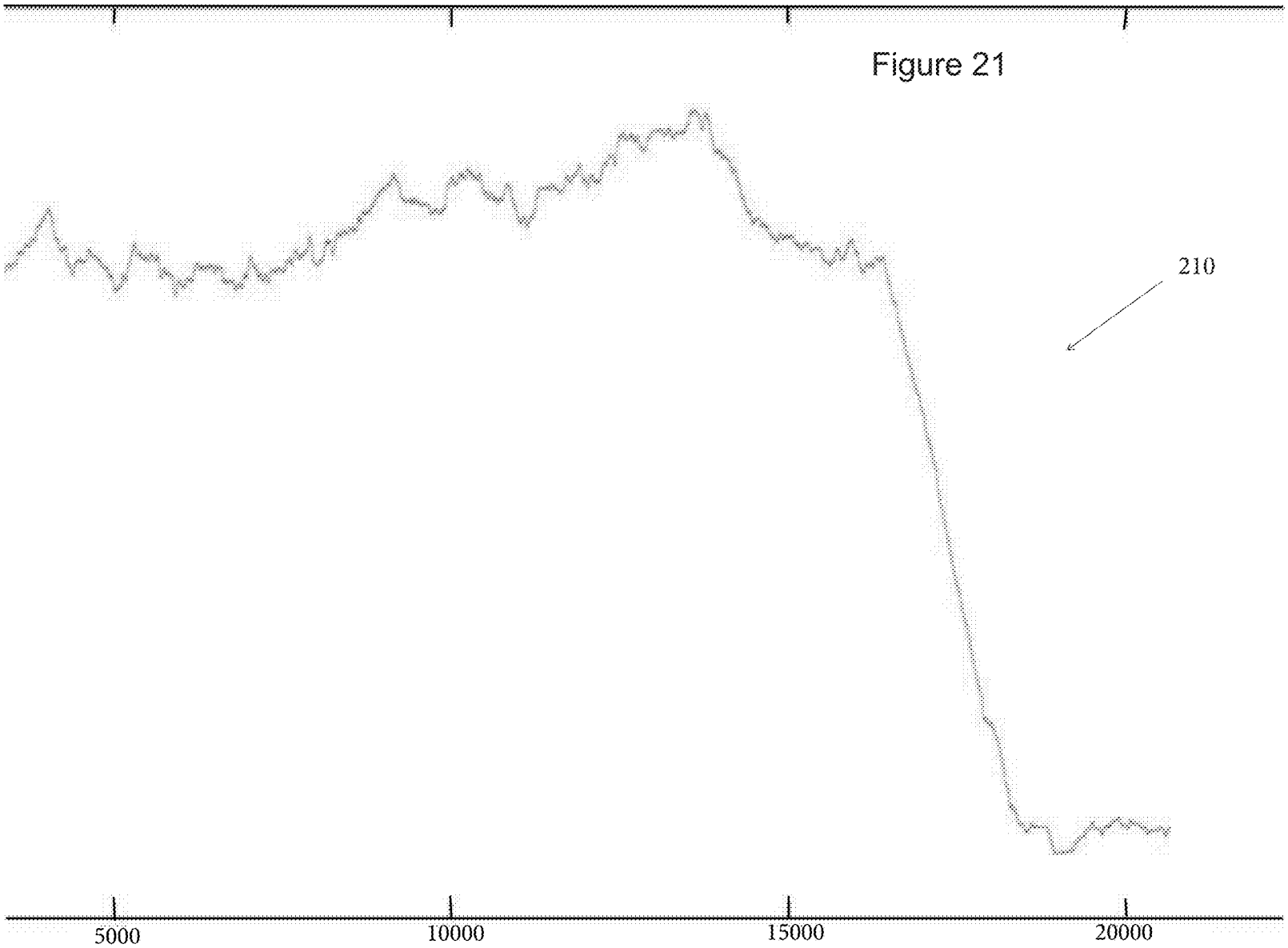
FIG. 21 is a graph of the average from FIG. 20 in accordance with the disclosed invention.

FIG. 14 is a graph 200 illustrating the readings as received from a sensor pair 360 where both threads 316A and 316B are moving through sensors 340 and 350, respectively, within the previously programmed, predetermine limits. In FIG. 15 the averaged data points from the readings illustrated in FIG. 14 are reflected in graph 202. In FIG. 16 the raw readings show that thread 3168 moving through sensor 350 has a tension higher than the control limits 124, while thread 316A remains within the limits. As the thread 3168 is higher than the control limits 124, the scan program 110 executes a stop machine 126 signal, determines the location of the sensor 136, and waits for reset 134. The averages of the readings are illustrated in the graph 206 of FIG. 17. In FIG. 18, the thread 316A, illustrated in graph 208, has broken prior to entry into sensor 340, indicating that the control signal is below limits 128. The scan program 110, reading a broken thread 316A, executes the stop machine 130 command, identifies the location of the sensor 132 and waits for reset 134. The averaged data points for graph 208 are illustrated in graph 210 of FIG. 21. Although the raw readings are generally not stored other than for averaging, it is possible to do so. In most applications only the averaged readings would be used and stored for the purpose of calculation and setting the control limits. It is possible to program the software to take the stored readings and, over time, use the readings to evaluate machine operation and yarn quality.

The use of the terms "a" and "an" and "the" and similar references in the context of this disclosure (especially in the context of the following claims) are to be construed to cover both the singular and the plural, unless otherwise indicated herein or clearly contradicted by context. An methods described herein can be performed in any suitable order unless otherwise indicated herein or otherwise clearly contradicted by context. The use of any and all examples, or exemplary language (e.g., such as, preferred, preferably) provided herein, is intended merely to further illustrate the content of the disclosure and does not pose a limitation on the scope of the claims. No language in the specification should be construed as indicating any non-claimed element as essential to the practice of the present disclosure.

Multiple embodiments are described herein, including the best mode known to the inventors for practicing the claimed invention, Of these, variations of the disclosed embodiments will become apparent to those of ordinary skill in the art upon reading the foregoing disclosure. The inventors expect skilled artisans to employ such variations as appropriate (e.g., altering or combining features or embodiments), and the inventors intend for the invention to be practiced otherwise than as specifically described herein.

Accordingly, this invention includes all modifications and equivalents of the subject matter recited in the claims appended hereto as permitted by applicable law. Moreover, any combination of the above described elements in all possible variations thereof is encompassed by the invention unless otherwise indicated herein or otherwise clearly contradicted by context.

The use of individual numerical values are stated as approximations as though the values were preceded by the word "about", "substantially", or "approximately," Similarly, the numerical values in the various ranges specified in this application, unless expressly indicated otherwise, are stated as approximations as though the minimum and maximum values within the stated ranges were both preceded by the word "about", "substantially", or "approximately." In this manner, variations above and below the stated ranges can be used to achieve substantially the same results as values within the ranges. As used herein, the terms "about", "substantially", and "approximately" when referring to a numerical value shall have their plain and ordinary meanings to a person of ordinary skill in the art to which the disclosed subject matter is most closely related or the art relevant to the range or element at issue. The amount of broadening from the strict numerical boundary depends upon many factors. For example, some of the factors which may be considered include the criticality of the element and/or the effect a given amount of variation will have on the performance of the claimed subject matter, as well as other considerations known to those of skill in the art. As used herein, the use of differing amounts of significant digits for different numerical values is not meant to limit how the use of the words "about", "substantially", or "approximately" will serve to broaden a particular numerical value or range. Thus, as a general matter, "about". "substantially", or "approximately" broaden the numerical value. Also, the disclosure of ranges is intended as a continuous range including every value between the minimum and maximum values plus the broadening of the range afforded by the use of the term "about". "substantially", or "approximately". Thus, recitation of ranges of values herein are merely intended to serve as a shorthand method of referring individually to each separate value falling within the range, unless otherwise indicated herein, and each separate value is incorporated into the specification as if it were individually recited herein. To the extent that determining a given amount of variation of some the factors. as well as other considerations known to those of skill in the art to which the disclosed subject matter is most closely related or the art relevant to the range or element at issue will have on the performance of the claimed subject matter, is not considered to be within the ability of one of ordinary skill in the art, or is not explicitly stated in the claims, then the terms "about", "substantially", and "approximately" should be understood to mean the numerical value, plus or minus 10%.

It is to be understood that any ranges, ratios and ranges of ratios that can be formed by, or derived from, any of the data disclosed herein represent further embodiments of the present disclosure and are included as part of the disclosure as though they were explicitly set forth. This includes ranges that can be formed that do or do not include a finite upper and/or lower boundary. Accordingly, a person of ordinary skill in the art most closely related to a particular range, ratio or range of ratios will appreciate that such values are unambiguously derivable from the data presented.

What is claimed is:

1. A yarn monitoring system for tension and breakage within a textile machine comprising:

a. a sensor bar, said sensor bar comprising:

i. a body having a length, a width, and a height;

ii. multiple eyelets extending through the height of said body, each of said multiple eyelets having an inlet and an outlet for passage of a yarn at a speed;

iii. multiple sensors, at least one of said multiple sensors being positioned at each of said multiple eyelets as dedicated sensors to create and detect signals based on said passage speed of said yarn;

iv. a circuit board within said body, said circuit board in communication with said multiple sensors to receive and transmit said signals;

a user-programmable controller, having a processor, said controller being in communication with said circuit board to receive said signals and with said textile machine to transmit commands;

wherein said controller is programmed with an acceptable signal range for signals transmitted by said dedicated sensors, said acceptable signal range being determined during a learning period run of said textile machine, and a predetermined time period for said signals to remain outside said acceptable signal range based on said signals received and averaged by said controller, and, wherein said signals received by said controller out of said acceptable signal range for said predetermined time period initiate commands to be sent from said controller to said textile machine.

2. The yarn monitoring system of claim 1 wherein said signals reflect a speed-of said yarn between said inlet and said outlet.

3. The yarn monitoring system of claim 1 wherein each of said dedicated sensors has an ID indicating location known by said controller to continually monitor functioning of each of said dedicated sensors.

4. The yarn monitoring system of claim 1 wherein said multiple sensors are photoelectric.

5. The yarn monitoring system of claim 1 wherein said textile machine is a tufting machine.

6. The yarn monitoring system of claim 1 wherein each of said multiple eyelets has at least one of said multiple sensors.

7. The yarn monitoring system of claim 1 wherein a low signal outside said acceptable signal range for said predetermined time period indicates said yarn is over tensioned.

8. The yarn monitoring system of claim 1 wherein lack of said signals indicates breakage of said yarn.

9. The yarn monitoring system of claim 1 wherein there is continuous communication between each of said multiple sensors with said circuit board, said circuit board with said controller, and said controller with said textile machine.

10. The yarn monitoring system of claim 1 wherein said communication to said textile machine is to stop operation.

11. The yarn monitoring system of claim 1 wherein said signals reflect a density of said yarn between said inlet and said outlet.

12. The yarn monitoring system of claim 1 further comprising a display element on said controller to display a current status of said textile machine.

13. A yarn monitoring system for tension and breakage within a textile machine comprising:

a. a sensor bar, said sensor bar comprising:

i. a body having a length, a width, and a height;

ii. multiple eyelets extending through the height of said body, each of said multiple eyelets having an inlet and an outlet and dimensioned to receive a yarn passing through at a speed;

iii. multiple sensor pairs, each of said multiple sensor pairs having a location ID and being positioned at said inlet and said outlet of each of said multiple eyelets to create and detect signals based on said passing of said yarn through said multiple eyelets;

iv. a circuit board within said body, said circuit board in communication with each of said multiple sensor pairs to receive and transmit said signals and said location ID;

vi. a controller having a processor, said controller being in communication with said circuit board to receive said signals and said location ID from said sensor pairs, and said controller being in communication with said textile machine to send commands based on said signals received;

wherein said controller is programmed with an acceptable signal range for signals created by passage of said yarn past said multiple sensor pairs, said acceptable signal range being obtained from averaging signals in a initial learning run of said textile machine, and a predetermined time period for said signals to remain outside said acceptable signal range, said controller averaging said signals, and wherein said controller is in continuous communication with each of said multiple sensor pairs to enable said controller to monitor a function of each of said multiple sensor pairs, and with said textile machine to send commands and, wherein communication from one of said multiple sensor pairs outside said signal range sends a stop command to said textile machine and displays said location ID for said multiple sensor pairs outside said signal range.

14. The yarn monitoring system of claim 13 wherein said multiple sensors are photoelectric.

15. The yarn monitoring system of claim 13 wherein said textile machine is a tufting machine.

16. The yarn monitoring system of claim 13 further comprising a display element on said controller, said display element displaying said machine status.

* * * * *